United States Patent [19]

Honma

[11] 4,364,120

[45] Dec. 14, 1982

[54] PICKUP CARTRIDGE OF MOVING COIL TYPE FOR PHONOGRAPH

[75] Inventor: Kimiyasu Honma, Machida, Japan

[73] Assignee: Kabushiki Kaisha Audio-Technica, Tokyo, Japan

[21] Appl. No.: 78,136

[22] Filed: Sep. 24, 1979

[30] Foreign Application Priority Data

Oct. 6, 1978 [JP] Japan ..... 53-123396

[51] Int. Cl.[3] ..... H04R 9/04; H04R 9/16

[52] U.S. Cl. ..... 369/138; 369/147

[58] Field of Search ..... 179/100.41 D, 100.41 K, 179/100.41 Z; 274/31, 36, 37; 369/172, 138, 147

[56] References Cited

U.S. PATENT DOCUMENTS

| | | | |
|---|---|---|---|
| 2,639,156 | 5/1953 | Ward | 179/100.41 Z |
| 3,299,219 | 1/1967 | Madsen | 179/100.41 K |
| 3,679,843 | 7/1972 | Cho | 179/100.41 K |
| 3,700,829 | 10/1972 | Anneberg et al. | 179/100.41 K |
| 3,760,125 | 9/1973 | Laue | 179/100.41 K |
| 3,851,117 | 11/1974 | Kuhn | 179/100.41 K |
| 4,093,833 | 6/1978 | Tsukamoto | 179/100.41 D |
| 4,205,856 | 6/1980 | Hayashi | 274/37 |
| 4,263,483 | 4/1981 | Obata | 369/147 X |

FOREIGN PATENT DOCUMENTS 2003700 3/1979 United Kingdom ..... 179/100.41 D

*Primary Examiner*—Bernard Konick
*Assistant Examiner*—Donald McElheny, Jr.
*Attorney, Agent, or Firm*—Fitch, Even, Tabin, Flannery & Welsh

[57] ABSTRACT

A phonograph pickup cartridge of moving coil type comprises a cartridge body and a stylus assembly detachably mounted on the body. The body includes a housing which firmly holds a permanent magnet and a pair of pole pieces. Magnetic gaps are defined between the pair of pole pieces in the region of the lower opening of housing. The housing carries a plurality of electrical terminal pins, which have their one end projecting externally from the rear end of the housing and which have their other end projecting through the bottom of the housing. The stylus assembly includes a knob member which supports a stylus subassembly having an armature which carries a pair of coils, and which also supports a plurality of electrical connectors which are adapted to be detachably coupled with the terminal pins. The ends of the coils are electrically connected with the connectors. When the terminal pins are engaged with the connectors, the pair of coils on the stylus assembly are properly disposed in the magnetic gaps defined between the pole pieces on the body.

7 Claims, 6 Drawing Figures

PICKUP CARTRIDGE OF MOVING COIL TYPE FOR PHONOGRAPH

FIELD OF THE INVENTION

The invention relates to a pickup cartridge of a moving coil type for phonograph, in particular, to such pickup cartridge having an interchangeable stylus assembly.

DESCRIPTION OF THE PRIOR ART

A classical phonograph pickup cartridge of moving coil type is disclosed in British Pat. No. 1,000,035 where a pair of coils are disposed at right angles to each other on a square armature of a magnetic material. These coils are disposed in magnetic gaps defined a pair of pole pieces extending from the ends of a permanent magnet for inducing a signal voltage therein in accordance with the oscillation of the armature. U.S. Pat. No. 3,299,219 discloses a cruciform armature which is substituted for the square armature, and a pair of coils are disposed in a cruciform configuration on the armature. In these pickup cartridges of moving coil type, the ends of the individual coils are firmly connected with electrical terminals which are disposed on a body of the cartridge, so that a stylus assembly including the armature which carries these coils cannot be readily removed from the cartridge body.

U.S. Pat. No. 3,679,843 discloses a phonograph pickup cartridge of moving coil type which facilitates an interchange of a stylus assembly as the stylus tip is abraded. In this cartridge, the body has a flat bottom surface on one end of which is formed a downwardly depending terminal plate. A plurality of terminal pins are secured to the terminal plate and extend therethrough to present their opposite ends located on the opposite sides of the terminal plate in a manner such that their axes lie parallel to the bottom surface. A stylus assembly has a flat upper surface and also include a side in which is secured a plurality of pin receivers which are engageable with each of the terminal pins. Thus, by moving the stylus assembly so that its upper surface slides along the bottom surface of the body to engage or disengage the pin receivers with or from one end of the terminal pins on the body, the stylus assembly can be made detachable with respect to the body. To realize such a detachable structure, a permanent magnet having a pair of pole faces which are exposed through the bottom surface is secured to the body while the stylus assembly has a pair of pole pieces or a yokes having their one end exposed through the upper surface of the stylus assembly so as to be brought into contact with the respective pole faces when the stylus assembly is properly mounted on the body. As a result, the stylus assembly is also held by magnetic attraction to the underside of the cartridge body as well as by engagement of the pin receivers with the terminal pins. The other ends of these yokes are disposed at a given spacing therebetween to define magnetic gaps therebetween. The stylus assembly includes an armature carrying a pair of coils and is supported by the other end of one of the yokes, with the pair of coils being disposed within the magnetic gaps together with the armature. The magnetic flux path circuit extends from one of the pole face of the permanent magnet on the body through one of the yoke, the armature disposed within the magnetic gap and the other yoke of the stylus assembly to the other pole face of the permanent magnet on the body.

However, there remains several problems with the improved pickup cartridge. Specifically, the stylus assembly is changed and disposed of as the stylus tip is abraded despite it includes yokes formed of a relatively expensive material. Thus, the stylus assembly cannot be inexpensively provided. Another problem results from an increased magnetic loss due to the length of a channel of a magnetic circuit which extends from the permanent magnet on the body through the yokes of the stylus assembly. A further problem relates to the failure of firmly mounting the stylus assembly on the body because the body and the stylus assembly are maintained in contact with each other along flat surfaces and are solely connected together by the engagement between the terminal pins and the pin receivers.

SUMMARY OF THE INVENTION

It is an object of the invention to provide a stereophonic pickup cartridge of moving coil type including a cartridge body and a stylus assembly which can be detachably mounted on the body in a facilitated manner wherein when the stylus assembly is mounted on the body, an armature of the stylus assembly carrying a pair of coils is properly disposed in magnetic gaps defined in the body.

In accordance with the invention, the body is provided with a permanent magnet and a pair of pole pieces, across the ends of which are defined magnetic gaps into which the armature of the stylus assembly is directly inserted, thus eliminating the need for the provision of yokes on the stylus assembly and hence minimizing the loss of magnetic circuit which occurs with such a construction.

In accordance with the invention, there is provided a pickup cartridge of moving coil type for phonograph comprising a cartridge body, and a stylus assembly detachably mounted on the body, the body including a housing, a permanent magnet secured within the housing, a pair of pole pieces connected with the permanent magnet and supported within the housing with one end of one of the pole pieces defining together with one end of the other pole piece a magnetic gap which opens into the lower surface of the housing, and a plurality of electrical terminal pins secured to the housing with their one end projecting externally through a side of the housing and their other end projecting externally through the lower surface of the housing, the stylus assembly including a knob member, a plurality of electrical connectors secured to the knob member for detachable engagement with the other end of the terminal pins, a stylus subassembly supported by the knob member and comprising a cantilever arm carrying a stylus tip on its one end and an armature supported by the other end of the arm and carrying a pair of coils thereon, and means for connecting the end of the coils with the connectors, the other end of the terminal pins and the connectors being aligned in a plane which is perpendicular to the axis of the cantilever arm with the magnetic gaps disposed in a plane perpendicular to the axis of the cantilever arm so that when the terminal pins are engaged with the connectors, the coils are disposed in the magnetic gaps.

According to an optional feature of the invention, the stylus assembly can be firmly mounted on the cartridge body by utilizing a detachable construction disclosed in U.S. Pat. No. 3,761,647 assigned to the common assignee as the present invention. In such a cartridge, the housing of the cartridge body is provided with a socket which opens into the lower surface thereof and which extends in a direction perpendicular to the axis of the cantilever arm while the knob member of the stylus assembly is provided with a columnar portion which fits in the socket. When the columnar portion is fitted into the socket, the stylus assembly can be detachably mounted on the body.

In a preferred embodiment of the invention, the armature is formed of a synthetic resin into a disc configuration, and fixedly carries a pair of independent rods of a magnetic material which extend upwardly from the armature in the manner of horns and around which a pair of coils are disposed. The axis of each rod has an angle of inclination of 45° relative to an imaginary vertical plane which includes the axis of the cantilever, with right angles being defined between the axes of the both rods. Alternatively, an armature of a magnetic material which comprises an annular portion and a pair of legs as disclosed in U.S. Pat. No. 3,679,843 may be used with coils disposed on the respective legs.

DESCRIPTION OF PREFERRED EMBODIMENT

Figure 1:
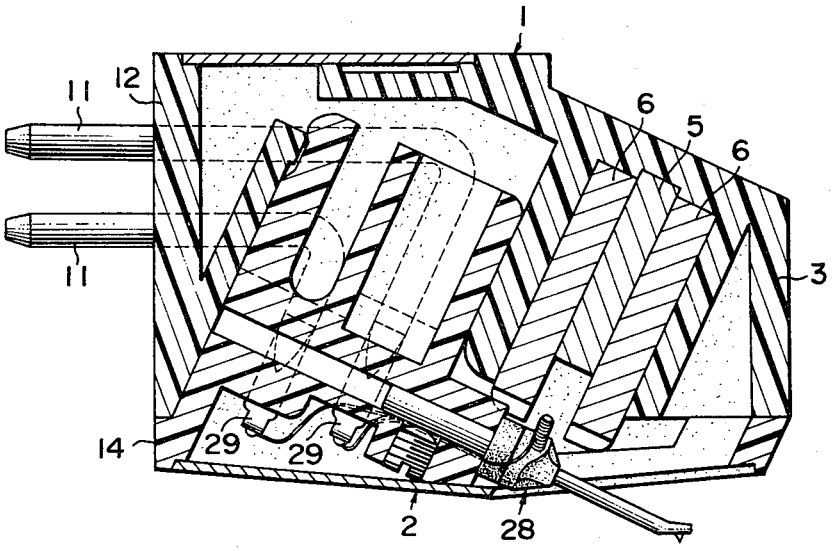
FIG. 1 is a longitudinal section of a phonograph pickup cartridge of moving coil type according to the invention.
Figure 5:
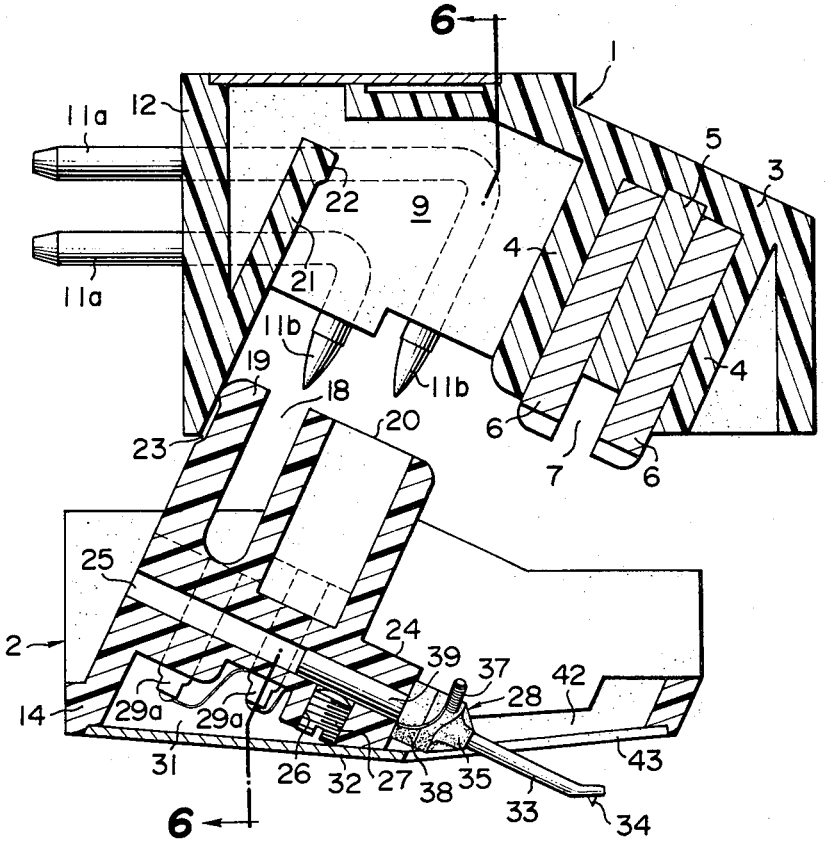
FIG. 5 is a longitudinal section of the cartridge, illustrating the cartridge body from which the stylus assembly is removed.

Referring to FIGS. 1 and 5, the phonograph pickup cartridge of moving coil type which is constructed in accordance with the invention comprises a cartridge body 1 which is mounted on the tone arm, and a stylus assembly 2 which is detachably mounted on the body 1 in a facilitated manner.

Figure 3:
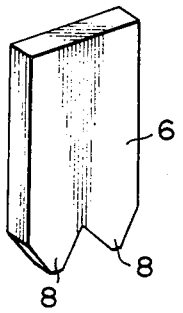
FIG. 3 is a perspective view of pole pieces used in the cartridge of FIG. 1.
Figure 6:
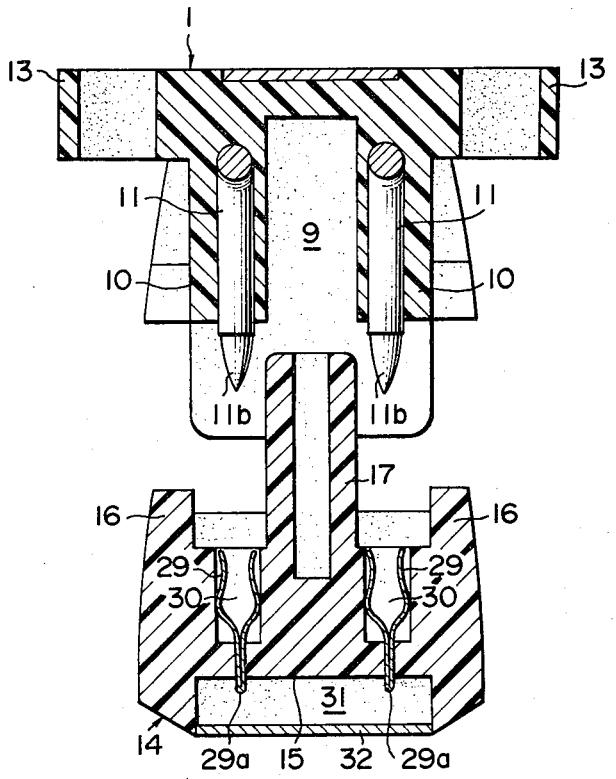
FIG. 6 is a longitudinal section taken along the line 6—6 shown in FIG. 5.

The cartridge body 1 includes a housing 3 which is molded from a synthetic resin and provided with a partition wall 4 in which a downwardly facing opening is formed. A plate-shaped permanent magnet 5 and a pair of pole pieces 6 which adjoin with the respective poles of the magnet 5 are firmly supported in the opening. The lower end of these pole pieces 6 extends beyond the corresponding end of the permanent magnet 5 to define magnetic gaps 7 therebetween. As will be apparent from FIG. 3, the end of each pole piece 6 is formed into a pair of triangular legs 8. A magnetic gap 7 is defined between each leg 8 of one pole piece 6 and the corresponding leg of the other pole piece. While the particular configuration of the pole pieces 6 is useful in forming an effective magnetic circuit which will be described later, it should be understood that the invention is not limited to such configuration, which may be replaced by a square plate. The permanent magnet 5 and the pair of pole pieces 6 constitute together a magnet assembly, and the housing 3 is also formed with a socket 9 of an increased size which is located adjacent to the magnet assembly and opens into the lower surface of the housing. Referring to FIG. 6, it will be appreciated that the socket 9 has opposite sidewalls 10 in which four L-shaped electrical terminal pins 11 (only two being shown) are embedded, with two pins in each sidewall. One end 11*a* of the terminal pins 11 projects through a rear wall 12 of the housing 3 while the other end 11*b* projects through the lower surface of the housing 3. The housing 3 is provided with a pair of mounting flanges 13 in order to permit the cartridge body 1 to be mounted on a tone arm. The ends 11*a* of the respective terminal pins 11 are electrically connected with electrical terminals, not shown, provided on the tone arm when the body 1 is mounted on the tone arm.

Figure 2:
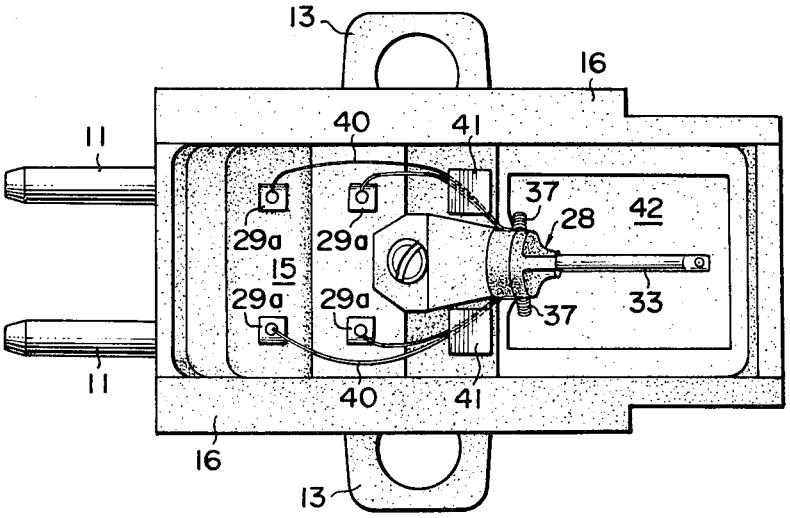
FIG. 2 is a bottom view of the cartridge, with a bottom cover being removed.

As will be apparent from FIGS. 2 and 6, the stylus assembly 2 includes a knob member 14 having a bottom wall 15 and a pair of sidewalls 16. The bottom wall 15 is formed with an upwardly extending columnar portion which is generally designated by reference numeral 17. The columnar portion 17 is sized to fit in the socket 9 formed in the housing 3, and comprises two segments 19, 20 which are separated by a slit 18 as will be apparent by reference to FIG. 5. The stylus assembly 2 is detachably mounted on the body 1 by inserting the columnar portion 17 of the knob member 14 into the socket 9. The segment 19 is resilient and flexed by a wall 21 of the socket 9 is being inserted into the socket to provide a detenting action as will be explained. To achieve a secure engagement between them, the wall 21 of the socket 9 is provided with a small projection 22 which is engageable with a recess 23 formed in the segment 19 of the columnar portion 17, the projection 22 engaging the recess 23 with a snap action when the columnar portion 17 is inserted into the socket. The bottom wall 15 of the knob member is formed with a raised portion 24 which is contiguous with the columnar portion 17, and a bore 25 extends through the raised portion 24 and the columnar portion 17. A stylus subassembly 28 is inserted into the bore 25 and held therein by a set screw 27 which threadably engages a threaded hole 26 extending in a direction perpendicular to the axis of the bore 25. Referring to FIG. 6, four electrical connectors 29 in the form of leaves are provided on the bottom wall 15 of the knob member 14, two each on the opposite sides of the columnar portion 17 even through only two connectors are shown in the drawing. The connectors 29 are firmly secured within openings 30 formed in the bottom wall 15, with their one end located on the upper side of the bottom wall 15 so as to be engageable with the ends 11*b* of the associated terminal pins 11 when the stylus assembly 2 is mounted on the body 1. The other end 29*a* of the electrical connectors 29 slightly projects into a cavity which is formed in the opposite side of the bottom wall 15. The cavity 31 is sealed by a bottom plate 32 which is connected with the knob member 14.

The specific detail of the stylus subassembly 28 is shown in FIG. 5 where it will be seen that it comprises a cantilever arm carrying a stylus tip 34 on its free end. An armature 35 formed of a synthetic resin is secured to the other end of the arm 33, and a pair of independent rods 36 (see FIG. 4) formed of a magnetic material have their one end supported by the armature 35 and project upward therefrom in the manner of horns. A pair of coils 37 are disposed on the respective rods 36. The components 33 to 37 constitute together a vibrator unit which is supported in a movable manner by a support assembly including a damper 38 of an elastic material and a mounting member 39. While not shown, the support assembly comprises a flexible suspension rod having its one end secured to the other end of the cantilever arm 33 or the armature 35 and extending through the damper 38 to be secured to the mounting member 39 at its other end. The stylus subassembly 28 is mounted on the knob member 14 by inserting the mounting member 39 into the bore 25 formed in the knob member 14 and clamping it with the set screw 27. In this respect, apertures 42, 43 (see FIGS. 2 and 5) are formed in the bottom plate 15 of the knob member 14 and the bottom plate 32 for allowing the passage of the cantilever arm 33 therethrough. The ends of the pair of coils 37 are connected with the other ends 29*a* of the electrical connectors 29 secured to the knob member 14, by means of lead wires 40. Each lead wire 40 is disposed along the lower surface of the bottom wall 15 and has its intermediate portion secured to the lower surface thereof as by adhesive type 41 (see FIG. 2). This is attractive in preventing voltage noises from being produced due to an oscillation of the lead wires.

Figure 4:
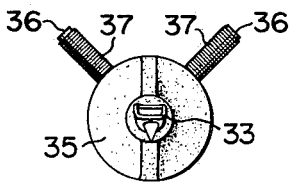
FIG. 4 is a front view of a stylus subassembly used in the cartridge of FIG. 1.

Referring to FIG. 4, it is to be noted that the pair of rods 36 mounted on the armature 35 lie on the opposite sides of an imaginary vertical plane which includes the axis of the cantilever arm 33 and each has an angle of inclination 45° with respect to the vertical plane so that an angle of 90° is formed between the axes of the both rods in a manner corresponding to the two modulated walls of a sound groove of a streophonic record disc. The axes of the rods 36 also lie in an imaginary plane which is at right angles to the axis of the cantilver arm 33.

One of the features of the present cartridge is the fact that the pair of coils 37 carried by the armature 35 of the stylus assembly 2 are properly disposed within magnetic gaps 7 defined between the pair of pole pieces 6 provided on the body 1 when the stylus assembly 2 is mounted on the body. To bring forth this result, the pair of pole pieces 6 are disposed in a plane which is perpendicular to the axis of the cantilever arm 33. To permit a reliable insertion and removal of the pair of coils 37 into and from the magnetic gaps 7 between the pole pieces 6, the socket 9 and the other ends 11*a* of terminal pins 11 provided on the body 1 as well as the columnar portion 17 and electrical connectors 29 provided on the stylus assembly 2 are aligned in a plane which is perpendicular to the axis of the cantilever 33.

In operation, the knob member 14 of the stylus assembly 2 is held by hand, and the columnar portion 17 thereof is inserted into the socket 9 formed in the housing 3, thus firmly mounting the stylus assembly 2 on the body 1. A frictional engagement is established between the socket 9 and the columnar portion 17 while projection 22 formed on the wall of the socket 9 snaps into the recess 23 formed in the columnar portion 17. In the process of such engagement, the electrical terminals 29 of the stylus assembly 2 are engaged by the corresponding electrical terminals 11 on the body 1. Also, a frictional engagement is established between the opposite sidewalls 16 of the knob member 14 and the opposite sidewalls 10 of the housing 3. The connection between the stylus assembly 2 and the body 1 which is achieved between the columnar portion 17 and the socket 9, between the terminal pins 11*a* and connectors 29 as well as between the sidewalls 16, 10 assures a firm engagement therebetween. However, it is also contemplated in the present invention that the stylus assembly 2 be connected with the body 1 only by the engagement between the terminal pins 11 and the connectors 29. When the assembling operation is complete, the coils 37 of the stylus assembly 2 are properly disposed in the magnetic gaps 7 defined between the pair of pole pieces 6. Each of the coils 37 exhibits a high conversion efficiency since it is placed in a gap of an increased flux density formed between the triangular legs 8 formed at the end of the oppositely located pole pieces 6. Where the pair of rods are mounted on the armature with the angle of 45° with respect to the vertical, the resulting operation is detailed in U.S. Pat. Nos. 3,720,796 and 4,075,418 assigned to the common assignee as the present invention, and hence will not be specifically described. However, it is characterized by the fact that when only one channel of a sound groove in a record disc is modulated, one of the rods which corresponds to that channel oscillates alone while the other rod merely rotates about its own axis. When the both channels are modulated, the pair of rods experience a corresponding oscillation which is proportional to the modulation of the associated channel. As each rod 36 oscillates, a flux flow which passes through the rods axially causes a voltage to be induced across an associated one of the coils 37 which is disposed thereon. Because the pair of rods 36 are independent from each other, the flux flow which occurs in one of the rods 36 does not pass through the other rod, preventing noises from being produced in the coil which is disposed on the other rod.

While a particular embodiment of the invention has been described in detail, it should be understood that the invention is not limited to the specific embodiment disclosed herein, but that a variety of modifications and changes are possible. By way of example, instead of disposing the two coils on two independent rods of magnetic material, they may be disposed on two legs extending from an annular armature of a magnetic material.

What is claimed is:

1. A replaceable stylus assembly for attachment to another phonograph cartridge portion, said stylus assembly comprising a body having a bottom wall and a pair of side walls, an upstanding post on said body projecting upwardly from said bottom wall and above said side walls to fit into a recess in the said other cartridge portion;

a cantilever arm projecting downwardly and forwardly from said body;

a stylus tip on an outer free end of said cantilever arm;

armature means including a pair of rods of magnetic material projecting upwardly from said cantilever with the axes of the rods lying in a plane perpendicular to the axes of the cantilever arm and each forming an angle of 45° with respect to an imaginary vertical plane through the axis of the cantilever arm;

a coil on each of said rods;

said side walls defining a downwardly opening cavity in said body to admit pole pieces into close proximity to said coils on said rods;

electrical connector means disposed on each side of said upstanding post for connection to electrical connectors on said other cartridge portion;

and electrical lead means extending between said coils and said electrical connector means disposed on each side of said upstanding post.

2. A stylus assembly in accordance with claim 1 in which said upstanding post is split and a split portion thereof is resilient, and a detent means on said resilient portion will detent with said other cartridge portion.

3. A pickup cartridge of moving coil type for phonograph comprising a cartridge body, and a stylus assembly detachably mounted on the body, the body including a housing, a permanent magnet secured within the housing, a pair of pole pieces connected with the permanent magnet and supported within the housing with one end of one of the pole pieces defining together with one end of the other pole piece a magnetic gap which opens into the lower surface of the housing, and a plurality of electrical terminal pins secured to the housing with their one end projecting externally through a side of the housing and their other end projecting externally through the lower surface of the housing, the stylus assembly including a knob member having a columnar portion, a plurality of electrical connectors secured to the knob member for detachable engagement with the other end of the terminal pins, a stylus subassembly supported by the knob member and comprising a cantilever arm carrying a stylus tip on its one end and an armature supported by the other end of the arm and carrying a pair of coils thereon, said cartridge body having a socket to receive the columnar portion with frictional engagement, detent means cooperating with said columnar portion to interlock said columnar portion in said socket, said columnar portion projecting perpendicular to the axis of the cantilever arm, and means for connecting the end of the coils with the connectors, the other end of the terminal pins and the connectors being aligned in a plane which is perpendicular to the axis of the cantilever arm with the magnetic gaps disposed in a plane perpendicular to the axis of the cantilever arm so that when the terminal pins are engaged with the connectors, the coils are disposed in the magnetic gaps.

4. Phonograph pickup cartridge of moving coil type according to claim 3 in which the armature is molded from a synthetic resin material, and carries a pair of independent rods of magnetic material which have their one end secured to the armature and extending upwardly therefrom in the manner of horns, the pair of coils being disposed on the respective rods, and in which the axes of the rods lie in a plane which is perpendicular to the axis of the cantilever and form an angle of inclination of 45° with respect to an imaginary vertical plane which includes the axis of the cantilever, whereby the axes of the rods are at right angles to each other.

5. Phonograph pickup cartridge of moving coil type according to claim 3 in which the pair of pole pieces comprise plate members disposed in abutment against respective magnetic poles of the permanent magnet, the end of each plate member being formed with a pair of legs, with the magnetic gap being defined between the leg of one plate member and the corresponding leg of other plate member.

6. A pick up cartridge of the moving coil type for a phonograph comprising:

a cartridge housing for mounting on a tone arm;

a separable and replaceable stylus assembly, having a body;

electrical connector means on each of said cartridge housing and said stylus assembly body for mechanical interlocking to assist in securing said body to said cartridge housing and to provide electrical interconnections therebetween;

a cantilever arm projecting downwardly and forwardly from said stylus body;

a stylus tip on an outer free end of said cantilever arm;

armature means including a pair of rods of magnetic material projecting upwardly from said cantilever with the axes of the rods lying in a plane perpendicular to the axis of the cantilever arm and each forming an angle of 45 degree with respect of an imaginary vertical plane through the axis of the cantilever arm;

a coil on each of said rods;

lead means connecting said coils to said electrical connector means;

said stylus body defining an opening about said rods and said coils thereon; and a permanent magnet and pole pieces located adjacent and in close proximity to said coils and said rods and defining magnetic gaps;

said electrical connector means comprising a plurality of parallel pins and a plurality of receiving connectors having frictional engagement with said pins.

said cartridge including:

a post projecting upwardly from the cantilever arm and being perpendicular to axis through the cantilever arm, and a socket means for receiving said postopening downwardly and in direction perpendicular to the axis of the cantilever arm, said post and socket means having frictional engagement and positioning rods carrying the coils with the axes of the rods at an angle of 45 degree with respect to the imaginary vertical plane Which includes the axis of the cantilever and at a vertically disposed position relative to the permanent magnet and the magnetic gaps.

7. A cartridge in accordance with claim 6 in which said pole pieces comprise a pair of plates disposed on opposite sides of said permanent magnet, said plates each having V-shaped lower ends with the points of the shaped ends being aligned and spaced from each other and receiving one of said coils in the space therebetween.

* * * * *